US005616084A

United States Patent [19]

Heddon et al.

[11] Patent Number: 5,616,084

[45] Date of Patent: Apr. 1, 1997

[54] SINGLE CYCLE PIN SETTING APPARATUS AND METHOD

[75] Inventors: Will Heddon, Lake Hamilton; Ralph E. Redman, Winter Haven; Lewis W. Slimak, Jr.; Sidney Tucker, both of Lake Wales; Dean H. Truesdell, Winter Haven, all of Fla.

[73] Assignee: Heddon Development Corp., Lake Hamilton, Fla.

[21] Appl. No.: 543,955

[22] Filed: Oct. 17, 1995

[51] Int. Cl.[6] ..... A63D 5/08

[52] U.S. Cl. ..... 473/73; 473/67; 473/101

[58] Field of Search ..... 473/54, 57, 65, 473/73, 83, 86, 89, 90, 91, 100, 101, 64, 66, 67

[56] References Cited

U.S. PATENT DOCUMENTS

| | | | |
|---|---|---|---|
| 1,627,414 | 5/1927 | Schaffer | 473/57 |
| 2,319,925 | 5/1943 | Flanagan | 473/57 |
| 2,879,997 | 3/1959 | Black et al. . | |
| 2,983,510 | 5/1961 | Blewitt, Jr. . | |
| 3,240,493 | 3/1966 | Cohen . | |
| 3,265,390 | 8/1966 | Stauth | 473/57 |
| 3,386,734 | 6/1968 | Congelli et al. . | |
| 3,401,934 | 9/1968 | Roop . | |
| 3,795,402 | 3/1974 | Bolger et al. . | |
| 3,809,398 | 5/1974 | Schmid et al. . | |
| 3,966,206 | 6/1976 | Schmid . | |
| 4,151,993 | 5/1979 | Payne et al. . | |
| 4,754,967 | 7/1988 | Edler et al. | 473/57 |
| 4,813,673 | 3/1989 | Schmid . | |
| 5,039,095 | 8/1991 | Buckley . | |
| 5,125,525 | 10/1992 | Brim et al. . | |
| 5,193,804 | 3/1993 | Smit . | |
| 5,372,551 | 12/1994 | McCarthy . | |

*Primary Examiner*—William M. Pierce
*Attorney, Agent, or Firm*—Allen, Dyer, Doppelt, Milbrath & Gilchrist, P.A.

[57] ABSTRACT

An automatic bowling pin setting apparatus and method for setting pins in a given pattern on a pin deck comprises detecting standing pins after a first ball has been rolled, clearing the pin deck of all pins, both standing and deadwood, and replacing the standing pins with replacement pins which have been stored in spotting cups above each of the pin setting locations of the pattern. The standing pin detection, pin deck clearing, and replacement of standing pins is made in a single cycle, thus eliminating the traditional standing pin lifting cycle. Spotting deck and rake movement are coordinated using shafts having continuous grooves of varying pitch with sliding members attached to the spotting deck and rake for controlling their coordinated movement with variable speed in a synchronized manner, thus permitting the single cycle for detecting standing pins, clearing the pin deck of all pins, and replacing those pins which were standing. A pin distributor delivers pins to a storage cradle above each spotting cup for storing in the vacant spotting cups. Typically thirty pins are used such that ten are on the pin deck, ten are stored in the spotting cups ready to replace detected standing pins, and ten are waiting in the cradles ready to be stored in the spotting cups. Such an arrangement reduces wear on the pins with the further efficiency of the pin setting equipment because of the single cycle pin setting process.

31 Claims, 10 Drawing Sheets

SINGLE CYCLE PIN SETTING APPARATUS AND METHOD

BACKGROUND OF INVENTION

1. Field of Invention

The invention relates generally to automatic pinsetters for bowling games, and more particularly to the detection of standing pins, sweeping of all pins on the pin deck, and respotting standing pins in a single cycle including the synchronous movement of the sweep rake and pin setting deck.

2. Background Art

Well known and generally accepted as a standard for operation of bowling alley pin setting equipment is the detecting of standing pins after a ball has been rolled, the lifting of such standing pins, sweeping of fallen pins or deadwood lying on the pin deck or lane into the pit area, and subsequent replacement or respotting of the lifted standing pins to their earlier positions. Automatic bowling pin setting of ten pins in a triangular pattern is typical. When the pins remain upright after a first ball has been rolled, as described, they are picked up vertically to a position above the pin deck area of the lane. The pins that have been knocked down are removed through a sweeping action of a rake which is moved horizontally along the lane surface toward the pit area where they are routed for delivery to a pin elevator assembly. Once the pin deck area is cleared of the deadwood, the earlier standing pins that have been lifted are repositioned at their original standing locations so that a second ball can be rolled in an attempt to knock down the standing pins.

In order to place ten pins onto the pin deck prior to the rolling of the first ball in a bowling frame, the pin setting deck, also referred to as a setup frame or setup deck, comprising ten pin bins or baskets each holding a pin, moves down from an elevated position above the pin deck, the pin baskets tilting from a horizontal to a vertical position where each pin is held by a bucket or spotting cell. Once the pins are positioned on the pin deck, the grippers open or the setup frame moves away from the pin deck leaving the standing pins in the preset ten pin triangular pattern. After the first ball is rolled, the first shot at knocking down the standing pins, the setup deck is lowered onto any remaining standing pins. Sensors detect which pins are standing and thus which have been knocked down and disclose such in a display visible to the bowler. With the setup deck lowered onto the standing pins, the grippers typically grab each standing pin by the neck and lift the pins sufficiently above the pin deck to enable a sweep rake to sweep the fallen pins to the end of the pin deck and into a pit area typically having a wide transport carpet or rolling conveyor belt which feed the pins to the pin elevator assembly. When the rake returns to its position in front of the pin deck, the setup deck moves downward toward the pin deck to reposition the pins which were temporarily lifted. The setup deck then moves to its elevated position to be filled again by pins which were delivered by the elevator assembly to a pin distributor assembly.

Such a pin setting apparatus is disclosed in U.S. Pat. No. 5,193,804 to Smit wherein an automatic bowling pin setting apparatus for setting pins in a given pattern upon a pin deck comprising a setup frame is adapted to move up and down above the pin deck by means of rack and pinion assemblies. Pin bins are mounted in the typical ten pin bowling pattern for tilting movement between a horizontal pin pick-up position and a vertical pin put-down position. The Smit '804 apparatus further comprises a horizontal conveying assembly for distributing the pins to the pin bins and an elevator assembly for supply distribution conveyors with pins knocked down and removed from the pin deck by a sweep barrier or rake. A pin setup frame motor drives the setup frame movement and a separate sweep barrier motor drives the rake assembly. As is typical in the art, yet another motor drives the pit carpet conveyor assembly.

Once the cleared pins have been delivered to the pit area and ultimately elevated, they are delivered, usually through a chute or other conveying means, to the pin distributor for delivery to the individual pin bins or baskets. Various methods and assemblies have been used for pin distribution to the pin bins within the pin setup deck. One such distributor is described in U.S. Pat. No. 5,372,551 to McCarthy et al. for distributing pins to a plurality of pin positions while reducing pin overflow to those positions. The McCarthy '551 patent discloses a pin setter that is adaptable to a variety of bowling styled games and provides for a variety of pin setting combinations. As discussed in McCarthy '551, a number of commercially available distributors and pin setters are available and have been described in various U.S. Pat. Nos. including 3,809,398 to Schmid et al., 4,813,673 to Schmid, and 5,152,525 to Brim et al. All seek to improve the flexibility and dependability, in one way or another, of pin setters that employ the multiple cycles for pin detecting, lifting, sweeping and respotting well known in the art. Further, as described, automatic pin setting equipment typically employed in the art comprises three motors, one for the operation of the setup deck or frame, a second for the rake or sweep barrier, and yet a third for the pit transport carpet. More motors mean more maintenance, more repair, more down time, more energy expended in both electric power and man power, and as a result added costs for the bowing alley owner. The present invention seeks to improve on this costly situation while providing a novel apparatus and method for setting bowling pins.

SUMMARY OF INVENTION

It is a principal object of the present invention to provide an automatic single cycle pin setting operation wherein pins standing, after a first ball of a frame has been rolled, are detected, all pins, including the standing pins and deadwood, on the lane at the pin deck area are swept into the pit area, and replacement pins are respotted where the standing pins were located. It is further an object of the present invention to provide such a single cycle operation with simplified and reduced components thereby reducing start-up and operating costs, associated with typical systems. It is yet another object of the invention to provide a single motor drive for the operation of the pin setting deck and rake assemblies thereby reducing the maintenance typically required in the industry for those assemblies each having an independent motor for driving the assembly. Such a single motor drive reduces a typically complicated setup deck and sweep rake. In providing the single cycle pin setting operation, it is a further object to provide for the synchronous yet variable movement of the pin setting deck and sweep rake while avoiding the need for reversing the drive motor.

To meet these objectives, a pin setting apparatus is presented which comprises means for moving a pin from a stored position above a lane to a standing position at a location on the lane, means for detecting a pin at a location below the stored pin, means for clearing the lane of any pins for placement of the stored pin at the location, and means cooperating with the moving and clearing means for synchronizing a simultaneous movement of the stored pin from its position to a standing position at that of the detected pip location. In the present invention, the clearing means removes the detected standing pin from the lane during the moving of the stored pin yet prior to placement of the stored pin at the standing position. Thus, the stored pin replaces the standing pin after the standing pin has been detected and removed from the lane.

In a preferred embodiment of the present invention, a spotting deck is movable toward and away from a bowling lane pin deck at an end of a lane for setting pins thereon. The spotting deck has a plurality of pin spotting cups for storing pins therein. There is a cup for each of a plurality of pin positions, wherein each cup is mounted for placing a pin in a standing position on the pin deck when the spotting deck is proximate the pin deck. The cups are at a pin loading position when the spotting deck is displaced above the pin deck. Further, each cup has sensing means for detecting a standing pin positioned below the cup during movement of the spotting deck toward the pin deck. A rake removes pins from the pin deck. The rake is movable between a position forward of the pin deck, wherein pins positioned on the pin deck are between the forward position and a pit area, and an aft position wherein the pins are pushed into the pit area. Means are provided for simultaneously moving the spotting deck and rake for synchronously lowering the cups for the detecting of standing pins, moving the rake to the aft position for depositing all pins on the pin deck into the pit area, returning the rake to its forward position, depositing pins stored in the cups onto the pin deck for those cups detecting the standing pins, and returning the spotting deck to its displaced position above the pin deck. The moving means is responsive to a signal indicating that a bowling ball has been rolled at the pins.

In the preferred embodiment of the present invention, the synchronous means comprises a spotting deck shaft having a continuous groove along a surface of the shaft. The groove has a varying pitch for controlling linear movement of spotting deck sliding means parallel to an axis of the shaft. Spotting deck sliding means are attached to the spotting deck, wherein rotation of the spotting deck sliding means about the shaft moves the spotting deck toward and away from the pin deck at various speeds throughout the movement. The continuous groove forms a continuous loop for continuous movement of the spotting deck toward and away from the deck even through changing directions without the need for reversing rotation of the shaft with respect to the sliding means.

In addition, there is a rake shaft which has a continuous groove along its shaft surface. The groove has a varying pitch for controlling linear movement of rake sliding means parallel to an axis of the rake shaft. Further, rake sliding means are attached to the rake, wherein rotation of the rake shaft within the sliding means moves the rake forward and back between the forward position and the aft position at various speeds throughout the movement for synchronization with the frame movement.

As a result of the above described invention, a method can be provided for setting bowling pins which comprises the steps of setting a pin in a standing position at a designated location on a pin deck for receiving a bowling ball rolled for knocking down the pin, detecting a first ball rolled at the pin, determining if the pin remains standing after the first ball has been rolled, sweeping the pin from the pin deck, and setting a replacement pin for the remaining standing pin at the designated location. Further, a second ball rolled at the standing replacement pin is detected, with remaining steps of sweeping the replacement pin from the pin deck, and setting another pin on the pin deck for repeating the detecting, determining, sweeping and replacement setting steps.

In a typical ten pin bowling operation, the preferred steps of the present inventive automatic pin setting method comprise positioning a plurality of standing pins on a pin deck in a patterned standing array for receiving a bowling ball rolled for knocking down the standing pins, each pin standing at a designated location of the array, detecting a first ball rolled at the pins, detecting the standing pins remaining at their designated location after the first ball is rolled, sweeping all the pins from the pin deck, the pins swept into a pit area, and positioning the detected standing pins remaining with replacement pins, each standing pin placed at a location corresponding to the detected standing pin which the replacement pin is replacing. The sweeping step comprises sweeping the standing pins remaining and fallen pins lying as deadwood on the pin deck and within a gutter adjacent the pin deck.

Further, the method continues with the steps of detecting a second ball rolled at the replacement standing pins, sweeping all the replacement pins from the pin deck, the replacement pins swept in to the pit area, and positioning another plurality of pins on the pin deck for repeating the detecting, sweeping and positioning steps.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
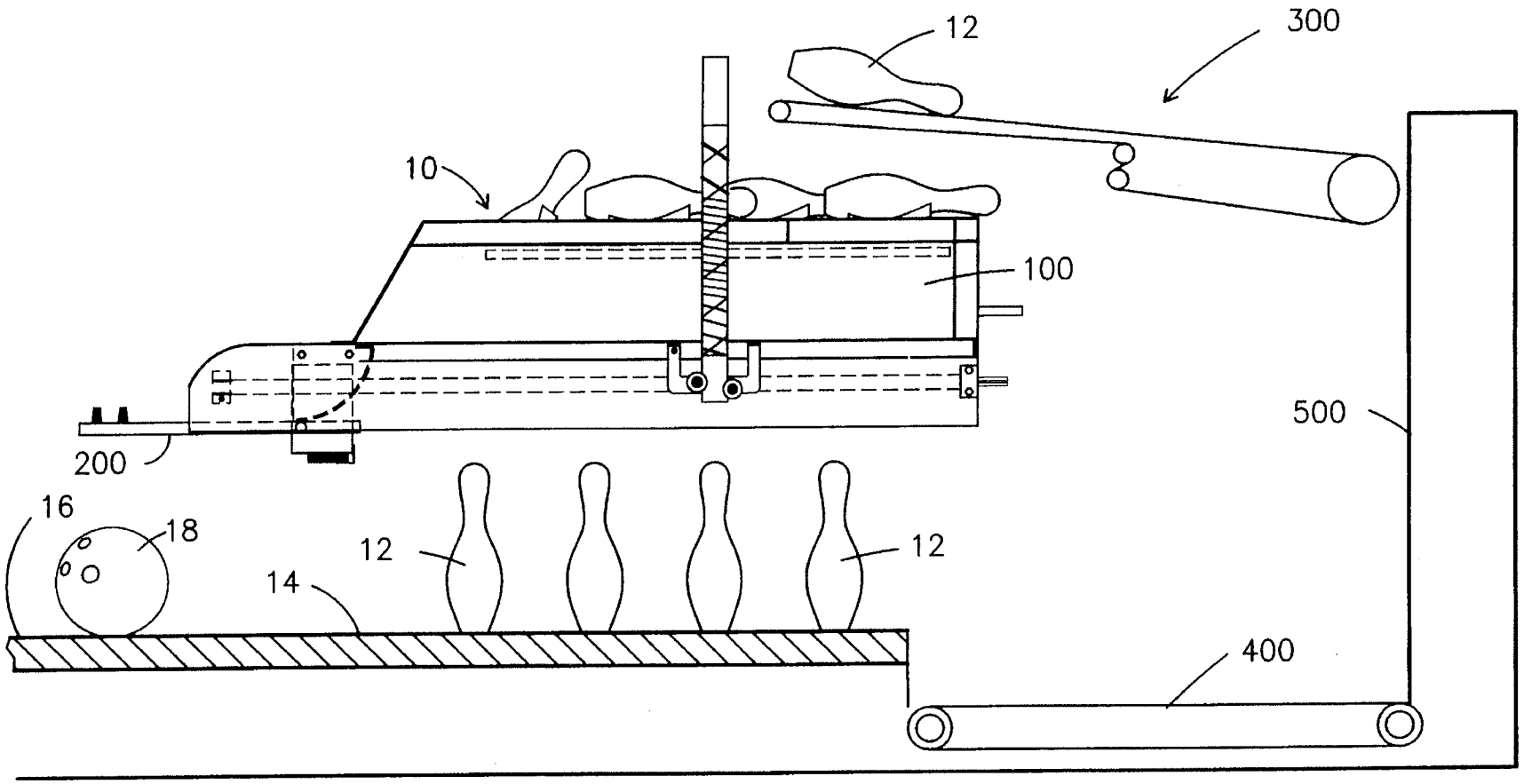
FIG. 1 is a partial schematic side elevation view illustrating a pin setting apparatus preferred embodiment of the present invention.

The preferred embodiment of the present invention provides for the automatic setting of bowling pins in a given pattern upon a pin deck at the end of a bowling lane. With reference to FIG. 1, a pin setting apparatus 10 comprises a spotting deck 100 and a rake assembly 200 which receives pins 12 from a pin distributor 300 for placement on a pin deck 14 at the end of a bowling lane 16. As illustrated again with reference to FIG. 1, the pin setting apparatus 10 cooperates with a pit transport carpet 400 which transports pins 12 swept from the pin deck 14 onto the pit carpet 400 to a pin elevator 500 for delivery to the pin distributor 300. As is typical in the art, the elevator 500 carries the pins 12 that have been knocked down and swept backwards over the pin deck 14 by the rake assembly 200 upwards to an elevated position from which the pins are supplied to the pin distributor 300 which supplies various pin setting devices. The attached drawings in detail description herein address the present invention, a pin setting apparatus 10 comprising elements of the spotting deck 100 in rake assembly 200 and their operation in cooperating with the balance of sub-assemblies well known to the art of bowling pin setting.

Figure 2:
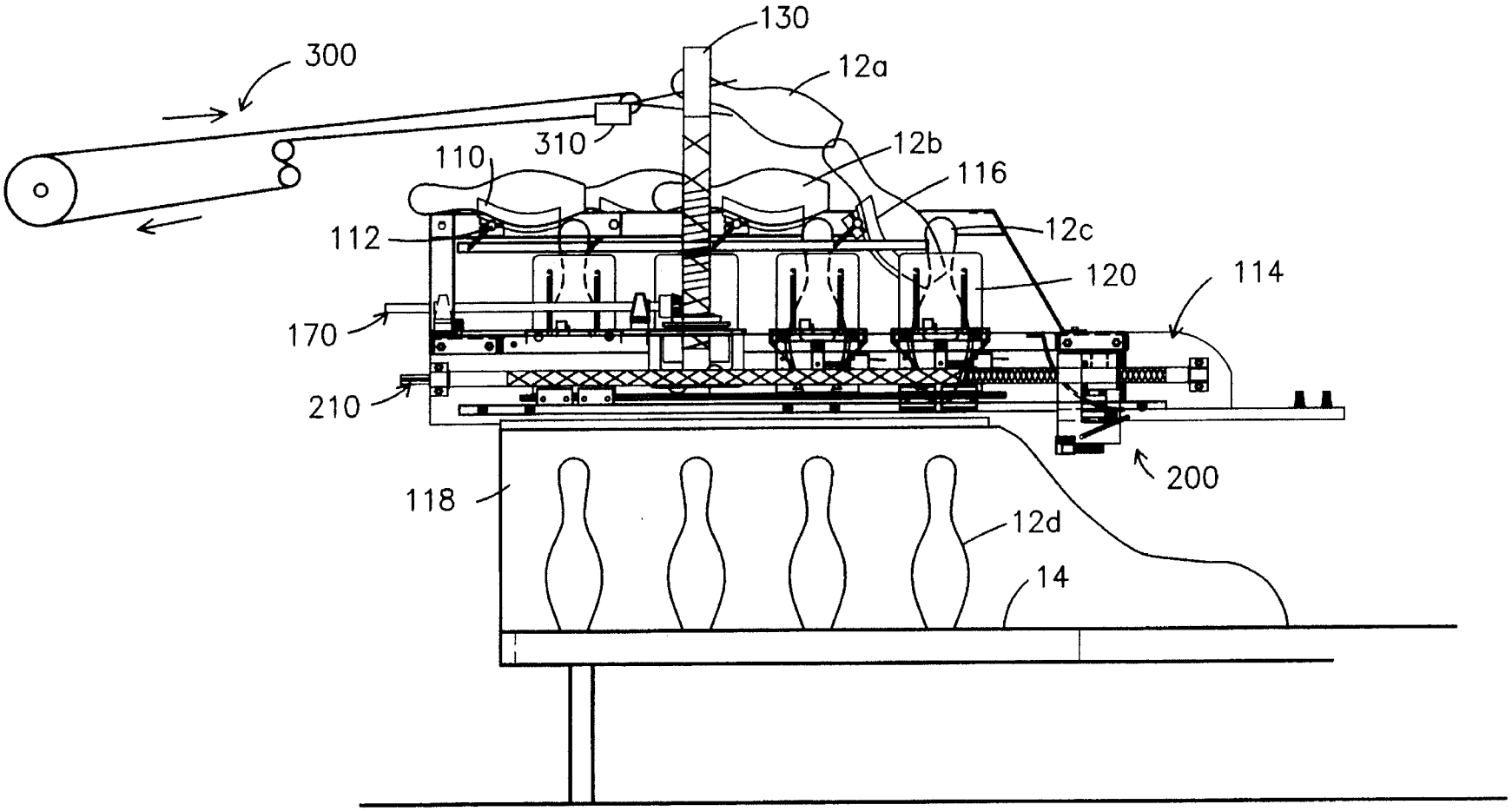
FIG. 2 is a partial left side elevation view of the apparatus of FIG. 1, illustrating pin distribution and storage elements.

With reference to FIG. 2, in operation, a pin 12*a* is delivered from the pin distributor 300 to a stored position 12*b* within a pin cradle 110 pivotally attached 112 to a frame 114. The cradle 110 holding the stored pin 12*b* rotates about its pivot 112, as illustrated by numeral 116, if a pin cup 120 is vacant, thus depositing the stored pin 12*a* into the pin cup 120 as illustrated by numeral 12*c*. As will be discussed in further detail later, the pin 12*c* stored in the pin or spotting cup 120 is delivered to the pin deck 14 wherein the pin 12*d* is in a standing position ready to receive an oncoming bowling ball 18, as illustrated again with reference to FIG. 1.

Figure 3:
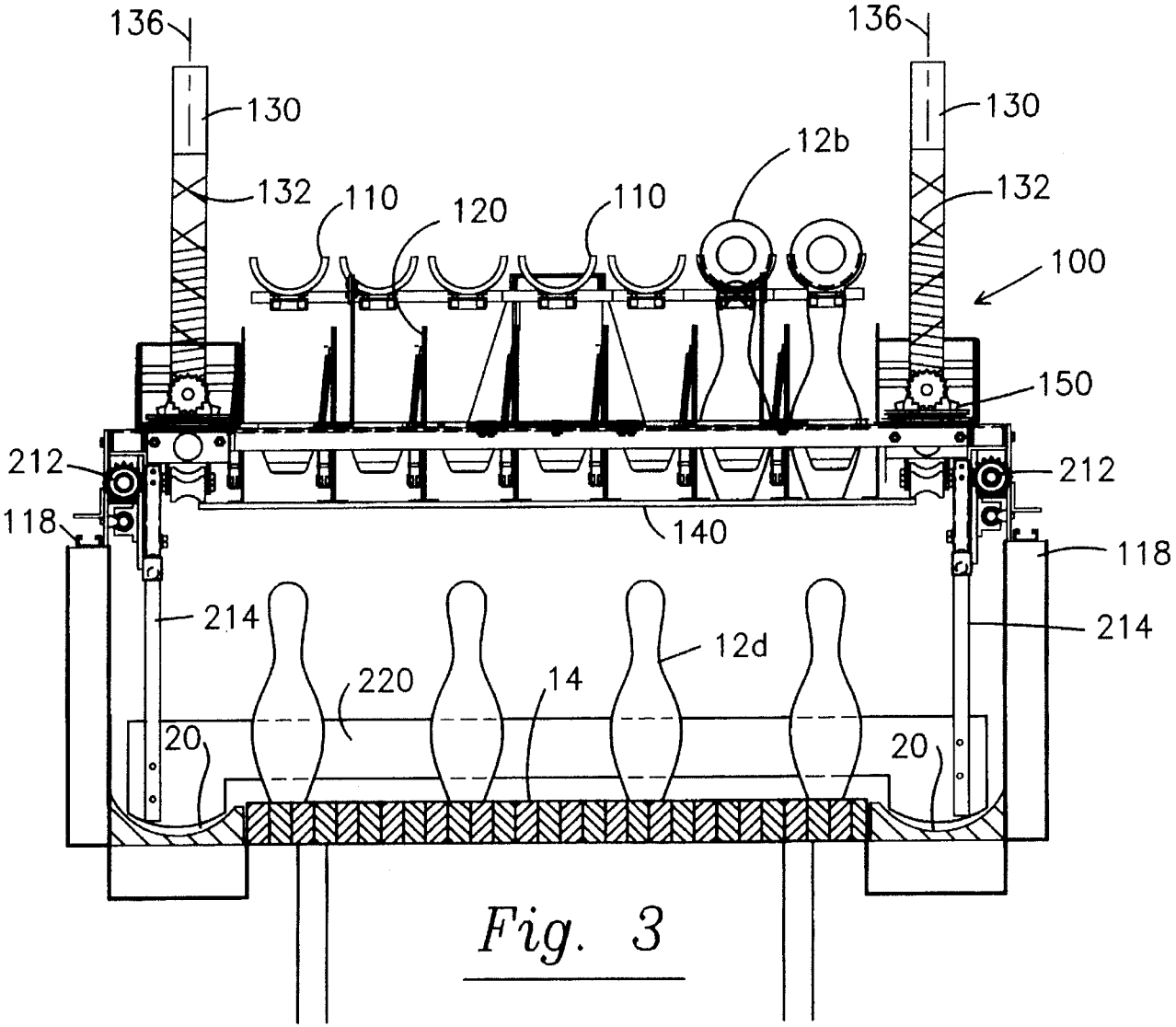
FIG. 3 is a partial rear elevation view of FIG. 3 further illustrating spotting deck and raking elements of the present invention.

As illustrated again with reference to FIG. 2, and to FIG. 3, the frame 114 is supported above the pin deck 14 by frame support members 118 on opposing sides of the frame 114. The frame 114 is mounted above the pin deck 14 in such a manner as to permit the spotting deck 100 to be moved up and down above the pin deck 14 for depositing the stored pins 12*c* within the pin cups 120 onto the pin deck 14 as earlier described. Further, the frame 114 provides support for the rake assembly 200 as will be described in further detail herein.

Figure 5:
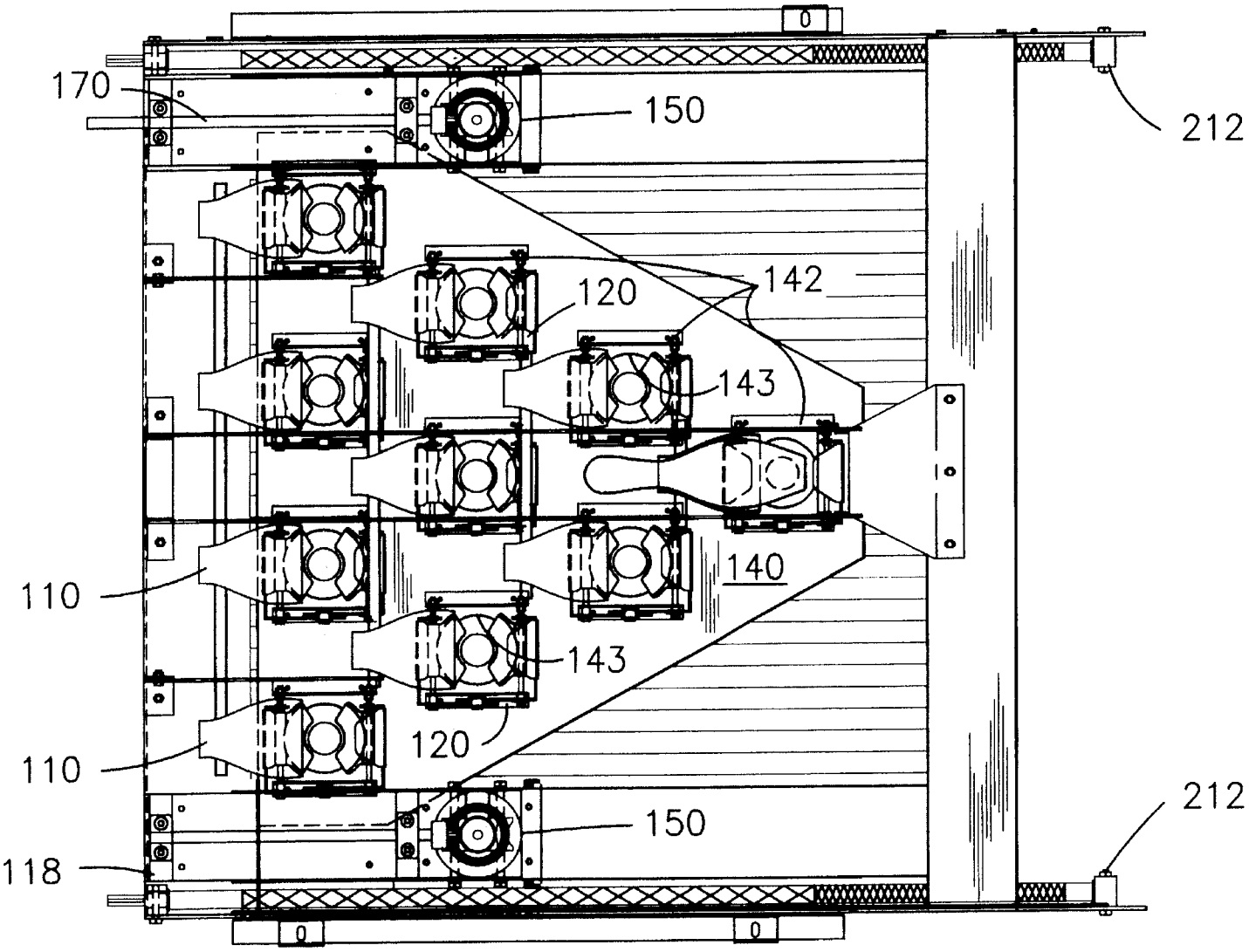
FIG. 5 is a partial top plan view of the spotting deck of the present invention.

Again with reference to FIGS. 2 and 3, the spotting deck 100 further comprises a pair of spotting deck shafts 130, each vertically mounted to opposing sides of a spotting deck plate 140, which plate 140 has a plurality of spotting cups 120 vertically attached thereto for movement toward and away from the pin deck 14. As will be described in detail later in this section, each shaft 130 has a groove 132 continuously formed (connected end to end) within a surface portion 134 of the shaft 130. The groove 132 has a varying pitch at various sections of the shaft 130 for controlling vertical movement and speed of the spotting deck plate 140 to and from the pin deck 14. With reference to FIG. 5, it can be seen that the pin deck plate 140 provides multiple pin locations 142 for placement of a pin cup 120 and pin cradle 110 at each of the locations 142, wherein pins 12*c* stored in the cups 120 are passed through openings 143 within the pin deck plate 140. The detailed description of the present invention addresses a typical ten-pin pattern with the understanding that multiple patterns or alternate locations 142 will be selected depending on a game of choice.

With reference to FIG. 4, and again to FIGS. 2, 3 and 5, the pin setting apparatus 10 includes a rake assembly 200. The rake assembly 200 comprises a pair of rake shafts 210 rotatably attached along frame opposing sides 212 as illustrated with reference to FIGS. 3 and 5. As illustrated with reference to FIG. 4, a rake arm 214 is pivotally attached to a slide member 216 for movement generally forward and aft over the pin deck 14 for sweeping standing pins 12*d* from the pin deck 14. As illustrated with reference to FIG. 3, a rake sweep member 220 extends across the pin deck 14 between the rake arms 214 pivotally attached to slide members 216 slidable along the opposing rake shafts 210. As illustrated with reference to FIG. 7, each rake shaft 210 comprises a continuous groove 222 within a shaft outside wall 224. The groove 222 has a varying pitch for controlling the linear movement and speed of the rake sliding member 216 parallel to axis of the shaft 226 as the sliding member 216 engages the groove 222 during rotation of the shafts 210. A motor in drive train assembly (not shown) is rotatably attached at a shaft end 228 for rotation of the rake assembly shafts 210 as illustrated again with reference to FIG. 4. In operation, rotation of the shaft 210 causes the slide member 216 engaging the varying pitch groove 222 to be moved linearly along a slide track 230 forward and aft. Prior to operation of the rake assembly 200, the rake arm 214 is in a rake arm stored position 214*a* wherein the rake arm 214 and thus the rake sweep member 220 are sufficiently above the pin deck 14 to allow the ball 18 to pass thereunder. As the shaft 210 is rotated, the slide member 216 moves aft permitting the rake arm 214 to be lowered in an initial movement position 214*b* and further dropped position 214*c* on its way towards sweeping pins 12*d* as illustrated with the rake sweeping position 214*d* in FIG. 4. The rake 214 further advances rearward to 214*e* until all the standing pins 12*d* have been removed from the deck 14. For that matter, the sweeping action of the rake assembly 200 clears all standing pins 12*d* and any dead wood (not shown) on both the pin deck 14 or side gutters 20.

Figure 6:
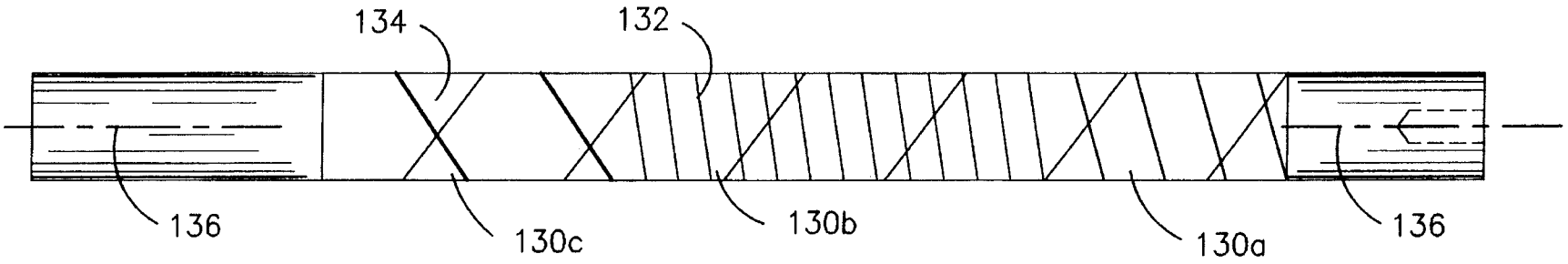
FIG. 6 is a partial side view of a frame variable pitch grooved shaft of a preferred embodiment of the present invention.
Figure 7:
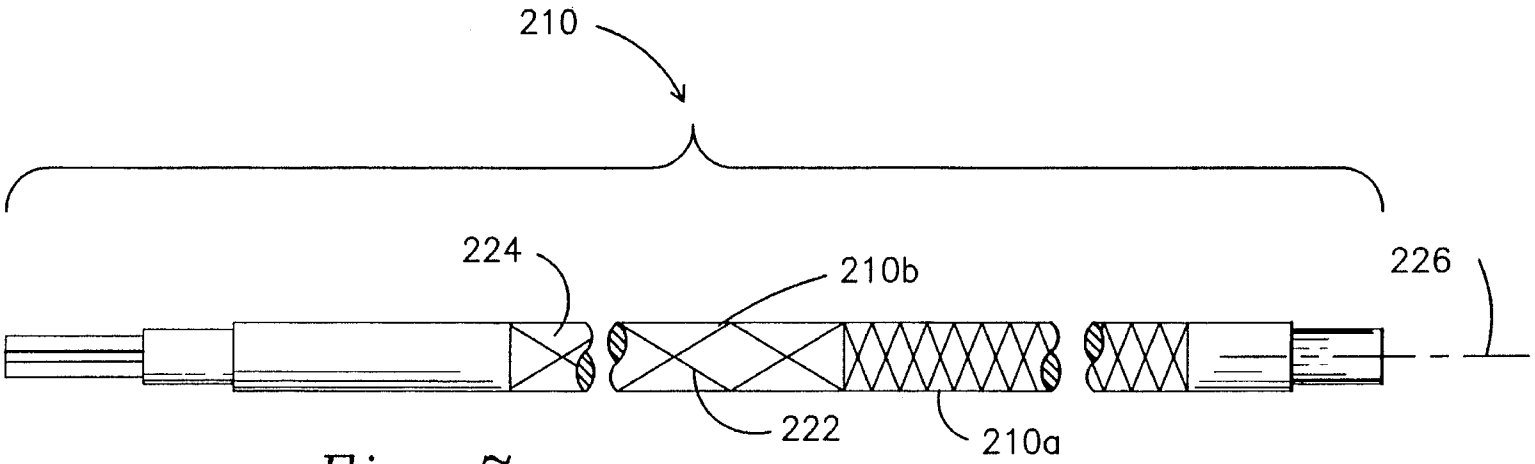
FIG. 7 is a partial rake variable pitch grooved shaft of a preferred embodiment of the present invention.

A critical part of the present invention rests in the movement of the spotting deck 100 while cooperating with the movement of the rake assembly 200 in such a way as to synchronize the simultaneous movement of each such that the pin 12*c* can be brought to a standing position on the pin deck 14 for replacing a detected standing pin 12*d* after the standing pin 12*d* has been swept from the pin deck 14 by the rake assembly 200, all completed in a single cycle. Thus, critical to the single cycle operation is the synchronizing of the spotting deck 100 and the rake assembly 200. Such synchronization is accomplished through the varying pitch spotting deck shafts 130 and rake shafts 210, and thus varying linear movement of each. With reference to FIGS. 6 and 7, the varying pitches of the preferred embodiment are illustrated for the spotting deck shaft 130 and rake shaft 210 respectively. In both shafts 130, 210 of the preferred embodiment, grooves 132, 222 are cut in shaft surface portions or side walls 134, 224 but it is anticipated that a ridge or alternate tracking means can be used. Again, it is the varying pitch along the axes of the shaft 130, 210 and the synchronization of the movement of the spotting deck 100 and rake assembly 200 because of such varying pitch that is critical to the synchronous operation of the present apparatus 10. Both shafts 130, 210 are rotated at a constant rotation and in the preferred embodiment of the present invention by a single motor (not shown). The continuous grooves 132, 222 permit continuous rotation about the axes of the shaft for driving the slide member 216 continuously through the cycle of its forward and back movement. In the preferred embodiment of the present invention, the spotting deck shaft 130 comprises three portions 130*a*, 130*b* and 130*c* of the shaft 130 wherein each portion has a predetermined pitch to the groove 132. The portion 132*a* is traversed with 4 turns of the shaft 130 wherein portion 130*a* has a pitch of 1.25. Portion 130*b* is traversed with 13 turns of the shaft wherein 130*b* has its groove at a pitch of 0.69. Portion 130*c* is traversed with 2 turns of the shaft wherein its groove has a pitch of 3. One cycle for the spotting deck would thus include traversing toward the pin deck 14 approximately 20 inches and away from the pin deck 14 to its displaced position above the pin deck another 20 inches wherein one cycle or movement of the pin deck plate 140 would thus travel a total of approximately 40 inches for the preferred embodiment herein described. Thus, by knowing the revolutions per minute of the motor used, or the revolutions per minute resulting after gear reduction, the linear travel along the axes of the groove shafts can be set knowing such rotation, groove pitch, and portion of the shaft having such a pitch. In a similar manner, as illustrated with reference to FIG. 7, the rake shaft 210 also has multiple portions of the shaft 210*a*, 210*b* wherein the pitch within these portions 210*a*, 210*b* vary so as to provide the desired linear movement along the shaft axis 226 with any device following the groove 222. As in the spotting deck shaft 130, the groove 222 of the rake shaft 210 is continuous thus permitting continuous rotation of the shaft 210 about its axis 226 to provide continuous linear movement along its axis 226 by the slide member 216 earlier described without the need for reversing rotation of the shaft 210 and thus without the need for a reversing motor typically found in pin setting equipment known in the art.

Figure 4:
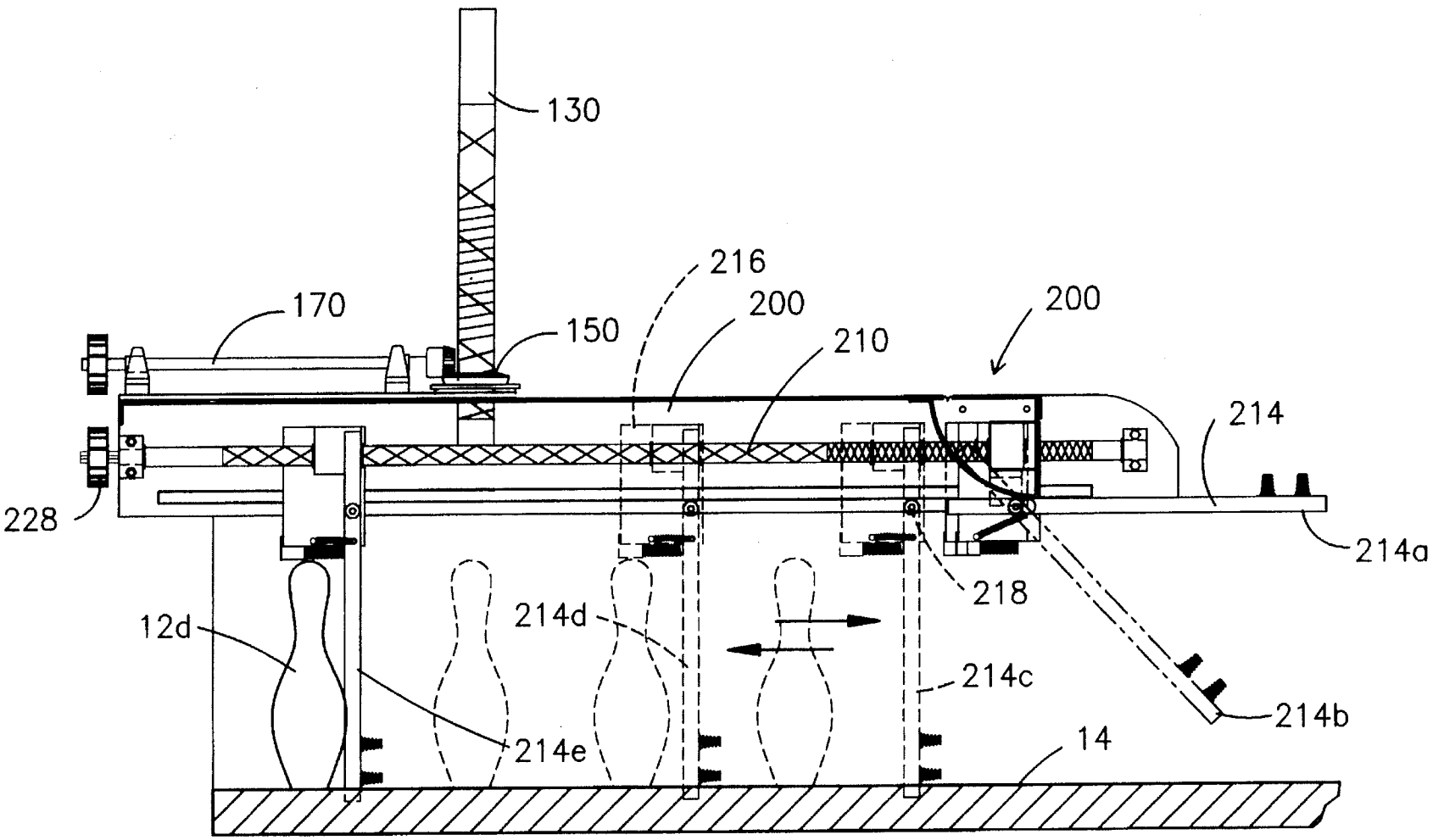
FIG. 4 is a partial left elevation view of the apparatus of FIG. 1, illustrating pin raking elements.
Figure 8B:
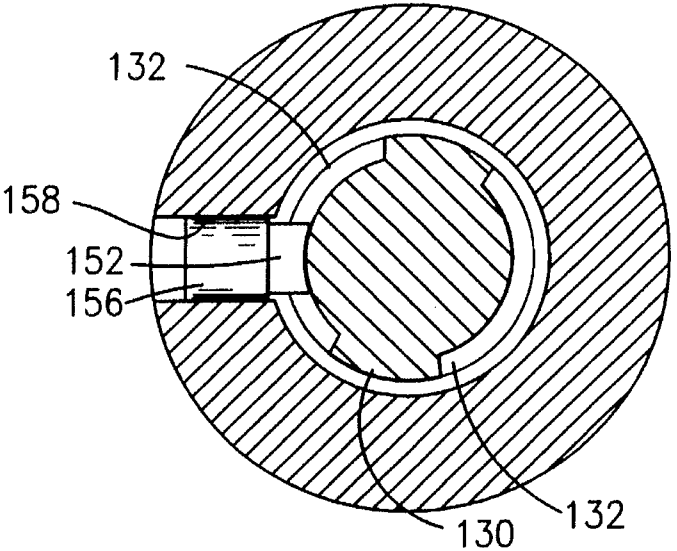
FIG. 8*b* is a partial cross-sectional view through section 8*b*—8*b* of FIG. 8*a;*
Figure 8C:
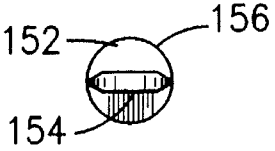
FIG. 8*c* is a top plan view of a slide member of the present invention.
Figure 8A:
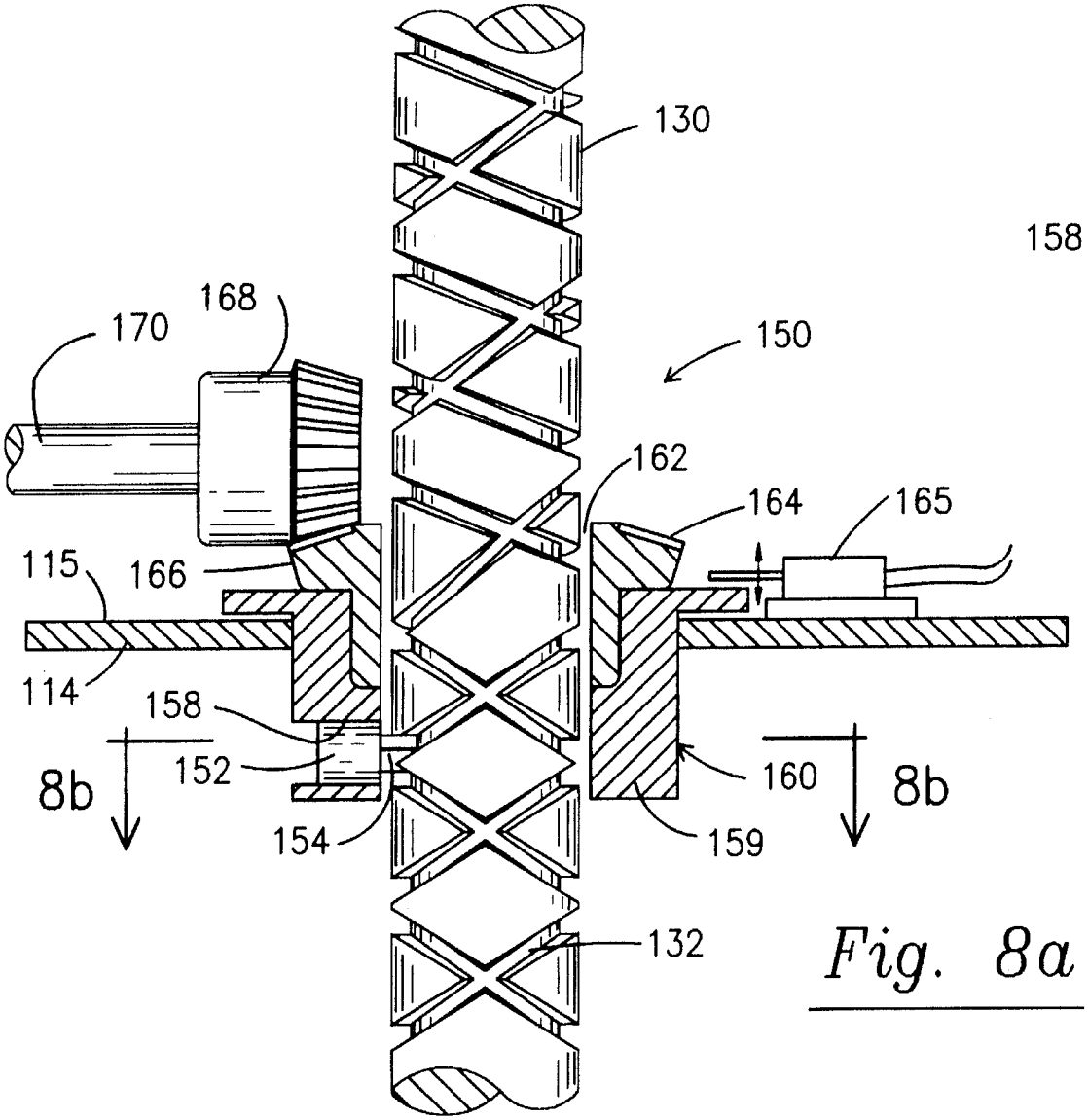
FIG. 8*a* is a partial cross-sectional view of a shaft drive assembly of the present invention.

With reference to FIGS. 8*a* through 8*c*, a sliding assembly 150 illustrated with reference to FIGS. 3 through 5 is described in further detail by way of example for the preferred embodiment of the present invention. As earlier described with reference to FIGS. 3 and 4, a motor drive (not shown) communicates with the rake assembly shafts 210 at a shaft end 228 for rotating the shaft 210 thus permitting the slide member 216 engaging with the groove 222 to be moved linearly parallel to the shaft axis 226. The spotting deck shafts 130 are affixed to opposing sides of the spotting deck plate 140. As illustrated with reference to FIGS. 8*a* through 8*c*, a slide member 152 has a groove engaging element 154 for tracking within the shaft groove 132. The slide member 152 has a generally cylindrical body portion 156 which is rotatable within a bore 158 within a side wall 159 of a sleeve 160. The sleeve 160 further has bore 162 through which the shaft 130 is slidably received. The sleeve 160 further has a beveled gear 164 about an end portion of the sleeve 166 for receiving a pinion gear 168 driven by a spotting deck intermediate drive shaft 170 as illustrated with reference to FIGS. 8*a*, 2 and 5. The arrangement of the sliding assembly 150 is such that rotation of the sleeve 160 about the shaft 130 forces the engaging element 154 and thus the slide member 152 to follow the groove 132 thus causing the shaft 130 to move relative to the sleeve 160. In the preferred embodiment of the present invention, and as illustrated again with reference to FIGS. 3, 4 and 5, the sliding assembly 150 is rotatably attached to the frame 114 for suspending the plate 140 therefrom, thus providing in linear movement of the shaft 130 and thus the plate 140 toward and away from the pin deck 14.

Figure 9B:
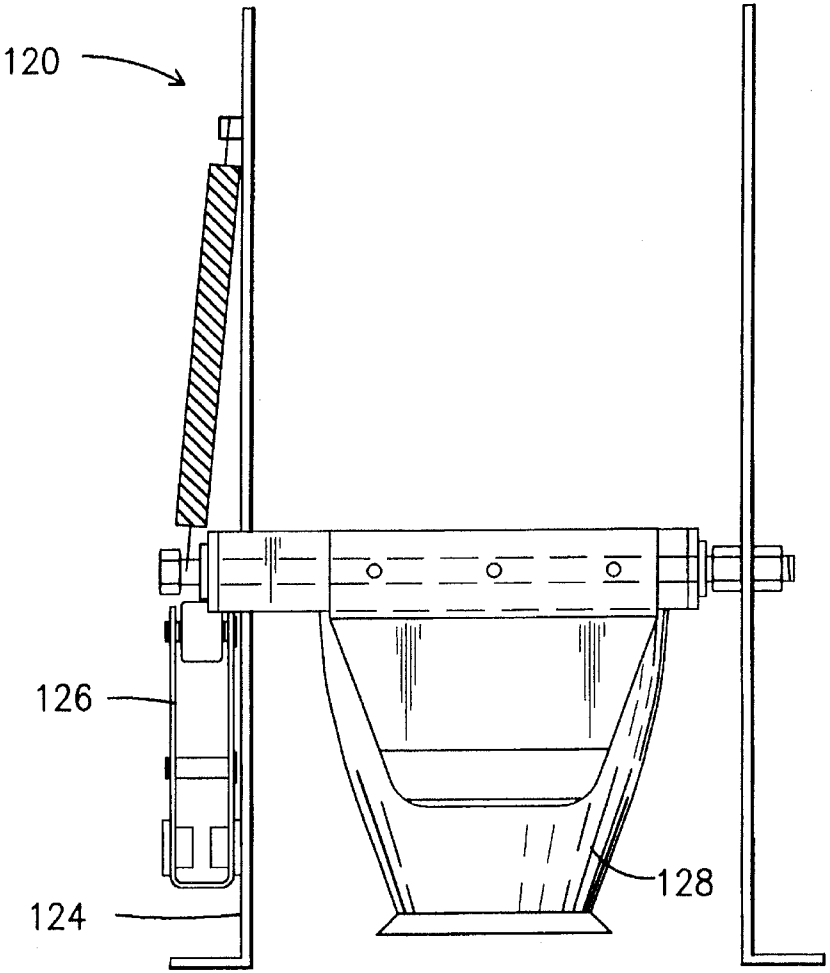
FIGS. 9*a*–9*c* are left side elevation, front elevation and top plan views respectively of a preferred embodiment of a pin cup of the present invention.
Figure 9A:
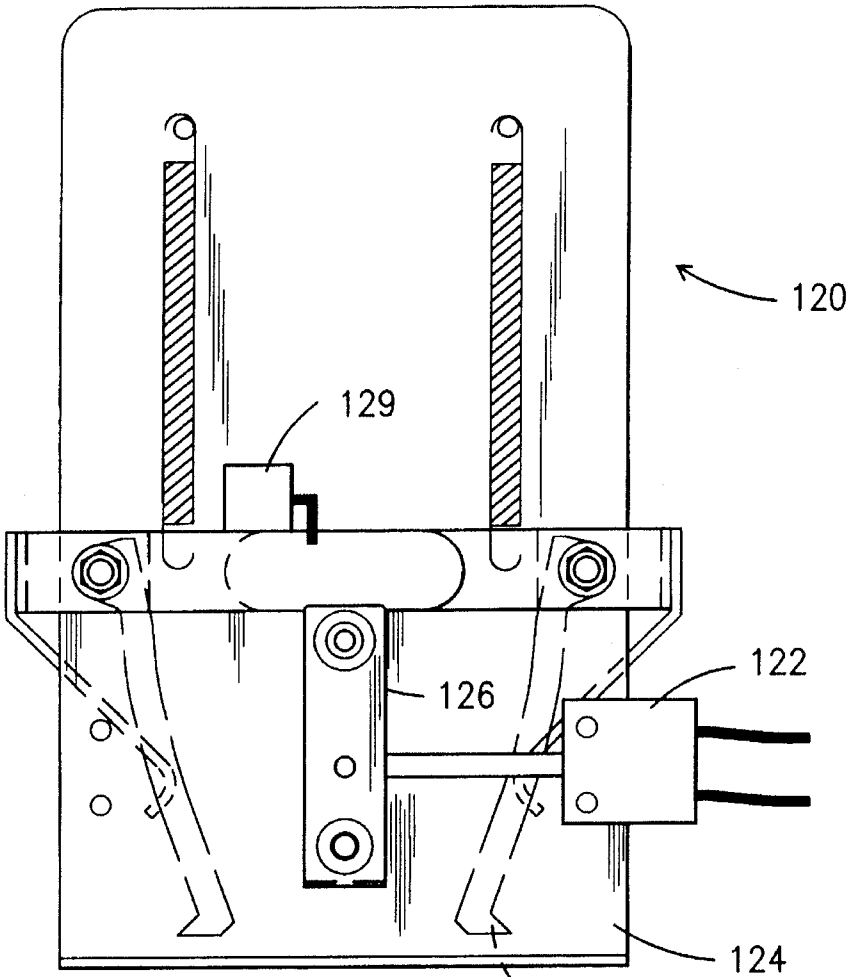
Figure 9C:
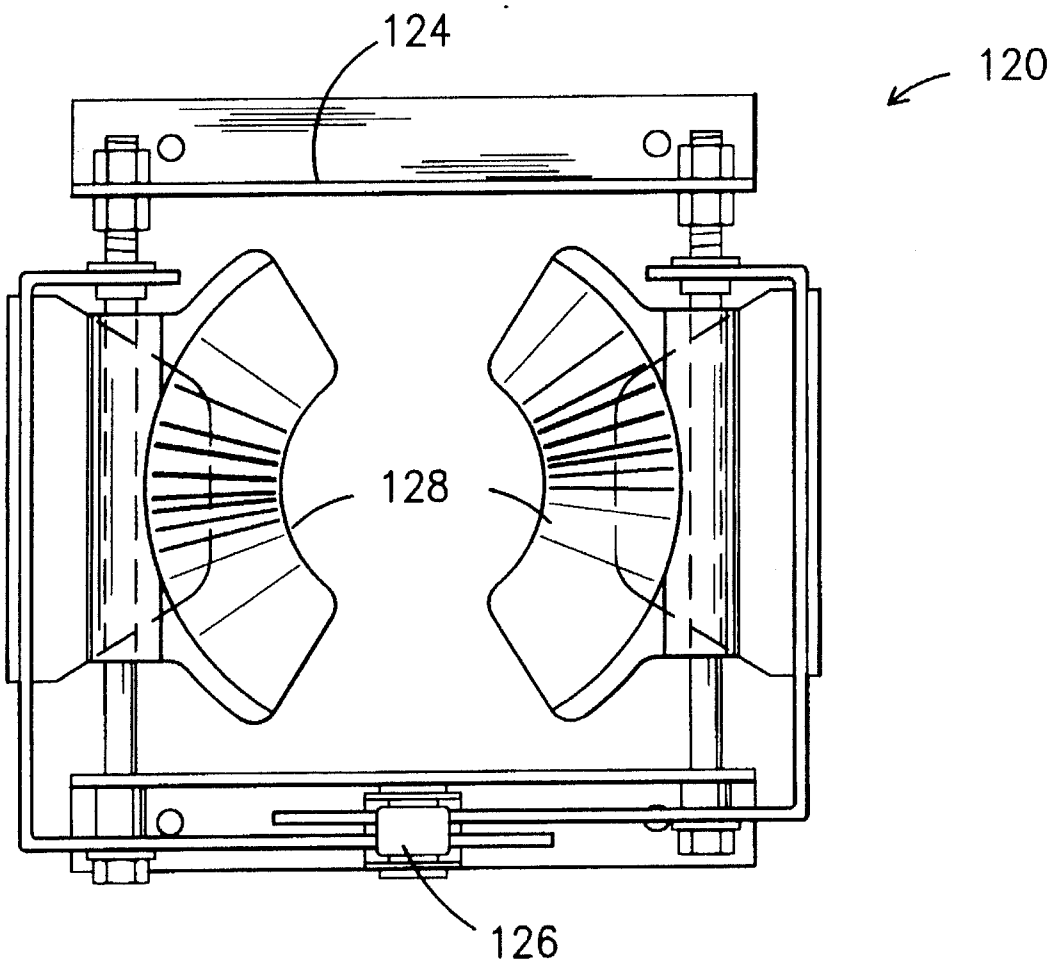

As will be further described with reference to the operation of the present invention, while the spotting deck plate 140 and thus pin cups 120 are moving toward the pin deck 14, it must be determined whether or not a standing pin 12*d* is positioned beneath a given cup 120. As a result, standing pins 12*d* must be detected. With reference to FIGS. 9*a* through 9*c*, each pin cup 120, in the preferred embodiment of the present invention, comprises a pin sensor solenoid 122 affixed to a pin cup side wall 124. The solenoid 122 is rotatably attached to a lever arm 126 which in turn is pivotally attached to the side wall 124. The pin cup cradles 128 are pivotally attached to cup side walls 124 for movement biasing against and away from a pin 12*c* as illustrated with reference to FIG. 2 positioned within the pin cup 120. Activation of the solenoid 122 rotatably attached to the lever arm 126 will hold or release the pin 12*c* within the pin cup 120. The pin cup 120 further comprises a switch 129 which provides a signal when the switch detects movement of the lever arm 126 caused by a standing pin 12*d* pushing against a stored pin 12*c* and displacing the stored pin 12*c* vertically upward in its pin cup 120. With such an arrangement, control of the pin cup 120 is such to either hold a pin 12*c* within the pin cup cradle 128 or release the pin 12*c* for placement in a standing position on the pin deck 14 as will be described later in further detail regarding the operation of the present invention. It is anticipated that alternate embodiments will detect standing pins using remote sensors, such as an CCD camera, sound or laser means. As earlier described, the pin 12*c* is placed within the pin cup by the pin distributor 300 first distributing a pin to pin cradles 110 pivotally attached at pivot 112 wherein a cradle 110 is proximate a pin cup 120 if a given pin cup 120, with reference again to FIG. 2, contains a pin 12*c*, the pin 12*b* resting within the pin cradle 110 will be stopped from dropping into the pin cup 120 by the pin 12*c*. In operation of the preferred embodiment, the raising of the pin deck plate 140 causes the pin cups 120 to release or unlatch the pin cradle 110 so that they are pivotal about pivot 112 for dropping the pin 12*b* into a corresponding pin cup 120. It is the pin 12*c* within the pin cup 120 that stops the movement of the cradled pin 12*b* from dropping into an already occupied pin cup 120. Once the spotting deck plate 140 and thus cups 120 are moved towards the pin deck 14 the cradles 110 are relatched for holding stored pins 12*d* received from the pin distributor 300. With such an operation, the pin distributor continuously operates to place pins within the pin cradles 110. The pin distributor 300 further comprises a sensing means 310 for determining whether or not a pin 12*b* is already within a pin cradle 110 of the given pattern. The pin distributor 300 is programmable to load the pins 12*a* received from the elevator 500 in a given preferred loading sequence.

Operation

Typically in pin setting devices, a ball trips a beam which starts drive motors for the pin setting equipment. A spotting deck is then lowered detecting standing pins and attaching to them for lifting above the pin deck as dead wood is swept from the pin deck. In a second cycle of operation of the spotting deck, it is lowered to the pin deck for respotting the standing pins. A second ball is then thrown at the respotted standing pins in the game of ten pin and the pin deck is then cleared of any pins remaining for placement of a new set of ten pins on the pin deck for a subsequent frame of bowling. As described, the present invention departs from the pin setting process and devices well known in the art by its delivery of a replacement pin 12*c* for any standing pins 12*d* detected by the spotting deck 100 during movement of the plate 140 toward the pin deck 14. In a single cycle, the pin deck 100 of the present invention detects standing pins 12*d*, sweeps them as well as, dead wood from the pin deck 14 and replaces the detected standing pins with a replacement pin 12*c* that is stored in the pin cup 120. All is completed in a single cycle and synchronized by the variable pitch grooves 132, 222 of the spotting deck and rake shafts 130, 212 respectively.

Figure 10:
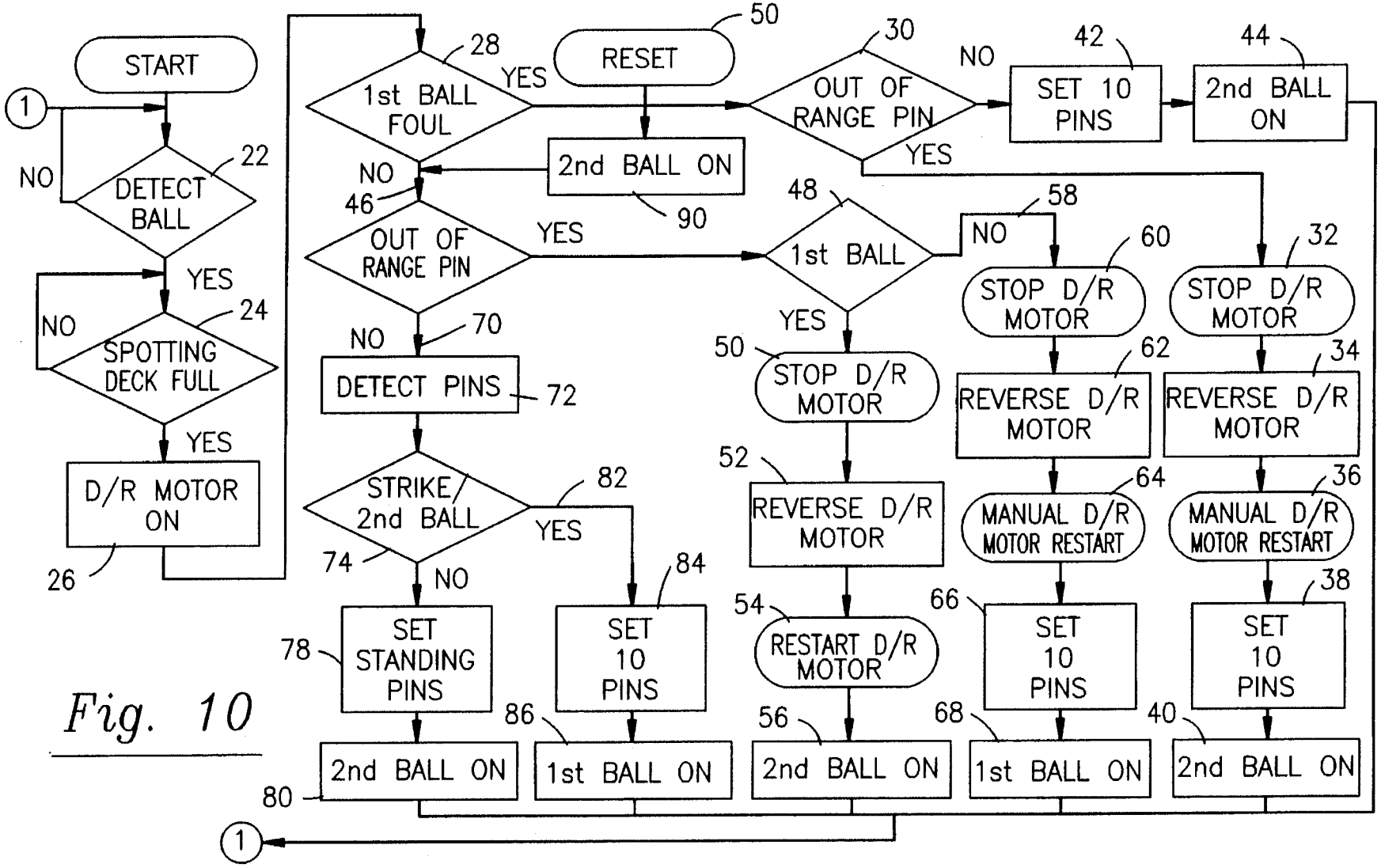
FIG. 10 is a flow chart illustrating a preferred operational logic of the present invention.

With reference to FIG. 10, the operational logic of the apparatus 10 for a preferred embodiment is detailed. With the apparatus 10 operational, a ball sensor (not shown in the apparatus drawings) functions 22 until a ball is detected. If a ball is detected, the controller checks to see if the spotting deck has a full complement of replacement pins 24. If not, the spotting deck will not move until the pin distributor has filled each cup of the spotting deck with a pin. If the spotting deck is full, the spotting deck and rake motor will be turned on 26 and the spotting deck lowered toward the pin deck. If it is determined by sensing that all ten pins remain standing and thus that the first ball is a foul 28, and if the spotting deck plate receives resistance from a standing pin indicating that a pin is out of range 30 the motor will be stopped 32, reversed 34 wherein it will remain until manually reset 36 after the out-of-range pin condition has been corrected. Once manually restarted, a set of ten pins will be replaced 38 on the pin deck and a second ball indication 40 provided. If after determining a first ball is foul and determining that no pins are out of range of the pin setter, the standing pins are cleared from the deck and a new set of pins 42 set on the pin deck wherein the second ball indicator is activated 44.

As illustrated again with reference to FIG. 8*a*, the slide assembly 150 includes the sleeve 160 suspending the shaft 130 and thus plate 140 from the frame 114, wherein gravity holds the sleeve 160 against a frame top surface 115. In the preferred embodiment of the present invention, a micro switch 165 is affixed to the frame 114 for detecting movement of the sleeve 160 upward. Such movement will occur when the plate 140 hits a standing pin 12*d* and the sliding assembly continues to operate, thus causing the sleeve 160 to climb up the shaft 130 thus making contact with the switch 165. The switch 165 provides a signal that will stop the drive motor until the out-of-range pin condition is corrected.

Again with reference to FIG. 10, if after the first ball is thrown and it is not a foul 46, again the plate switch again determines if a pin is out of range. If out of range and it is the first ball 48 that has been thrown, the motor will stop 50, reverse 52, and be restarted 54 after the out-of-range pin situation has been corrected. A second ball on signal 56 is then activated. If after the first ball is determined not to be foul 46, a pin is determined out of range and it is not a first ball 58, the motor is stopped 62, reversed 62 and manually restarted 64 as earlier described once the situation has been corrected. The pins are cleared from the deck and a new set of ten pins are positioned 66 but at this time with a first ball indicator on 68.

If the first ball is thrown and is not foul 46 and pins are not out of range 70, the pins are detected 72 and it is determined based on the first or second ball indicator signals whether it is a strike or second ball that has been thrown 74. If it is not a strike or not a second ball 76, a set of standing pins is positioned 78 based on the pins detected as earlier described and a second ball indicator signal is provided 80. If it is determined that it was a strike 82 after the pin detection 72, all pins are cleared from the deck and a new set of ten pins 84 is placed on the pin deck. A first indicator signal 86 is then provided for tracking balls during a subsequent frame.

In practice, at the beginning of the operational day, a reset signal 88 is provided which indicates that a second ball 90 has been thrown as a way of resetting the system and having it cycle through its operation by providing a second ball on signal 52 within the logic network.

In the preferred embodiment of the present invention, a Motorola micro controller is used. The MC68HC 16Z 1 Modular Micro Controller is a high speed sixteen bit control unit that is upwardly code compatible with M68HC11 controllers. The MC68HC16Z1 incorporates a true sixteen bit central processing unit, a system integration module, an 8/10 bit analog-to-digital converter, a queued serial module, a general purpose timer, and a 1024 byte stand by RAM. These modules are interconnected by an intermodule bus.

By way of further example for one embodiment of the spotting deck 100 and rake assembly 200, reference is made to Table 1 wherein a 12-second single cycle is illustrated by way of example using a motor having a 1725 rpm and appropriate reduction gears communicating with the spotting deck 100 and rake assembly 200. With such an arrangement, the drive motor assembly (not shown) includes a first gear reduction for 3.75:1, reducing a selected 1725 RPM motor to a 7.67 RPS of the rake shaft 210. The rake shaft end 278 is rotated at 460 RMP in this example as is the pinion gear 168. The pinion gear 168 and beveled gear 164 further reduce rotation of the sleeve 160 by a 4:1 ratio for rotating the slide member 152 about the deck shaft 130 at 1.92 RPS. In the Table 1 example, and again with reference to FIGS. 3 and 4, the rake slide member 216 travels approximately 104 inches within approximately 12 seconds, 52 inches aft and 52 inches forward from its stored position 214*a* to clearing the pin deck 214*d*, 214*e* and back to its stored position. The spotting deck plate 140 and thus the pin cups 120 travel approximately 40 inches, 20 inches down and 20 inches back over a period of approximately 12 seconds in synchronous movement with the rake assembly 200. Such synchronous movement is accomplished because of the varying linear movements of the spotting deck plate 140 and rake arm 214 resulting from the varying pitches of the shafts 130, 210, thus permitting the detection and sweeping of pins 12 and their replacement within a single cycle.

While a specific embodiment of the invention has been described in detail herein above, it is to be understood that various modifications may be made from the specific detail described without departing from the spirit and scope of the invention as set forth in the appended claims.

Having now described the invention, the construction, the operation and use of a preferred embodiment thereof, and the advantageous new and useful results obtained thereby, the new and useful constructions, methods of use and reasonable mechanical equivalents thereof, obvious to those skilled in the art, are set forth in the appended claims.

TABLE 1

| Sequence | Time (sec) | Rev | Pitch (inch/rev) | Travel (inches) |
|---|---|---|---|---|
| | RAKE TRAVEL | | | |
| | | | | MOTOR: 1725 RPM |
| | REDUCTION: 3.75:1 = 460 RPM = 7.67 RPS | | | |
| Rake Down | 3.2 | 24.0 | .50" | 12.0" |
| Rake Back | 2.8 | 22.0 | 1.82" | 40.0" |
| Rake Forward | 2.8 | 22.0 | 1.82" | 40.0" |
| Rake Up | 3.2 | 24.0 | .50" | 12.0" |
| TOTAL TRAVEL: | 12.0 sec. | | | 104.0" |
| | SPOTTING DECK TRAVEL | | | |
| | ADD'L REDUCTION: 4:1 = 115 RPM = 1.92 RPS | | | |
| Deck Detecting | 3.4 | 6.50 | .80" | 5.20" |
| Deck Going Down | 5.4 | 10.50 | .80" | 8.40" |
| Deck Set Pins | 0.8 | 1.46 | 4.40" | 6.40" |
| Deck Returned | 2.4 | 4.545 | 4.40" | 20.00" |
| TOTAL TRAVEL: | 12.0 sec. | | | 40.00" |

What is claimed is:

1. A pin setting apparatus comprising:

means for moving a first pin from a stored position above a lane to a standing position within a location on the lane, the moving means operable within a single continuous movement cycle, the cycle including a first portion operable from the first pin stored position to the first pin standing position, and a second portion operable from the first pin standing position returning to the first pin stored position;

means for detecting a second pin standing within the location, the detecting means operable within the moving means cycle first portion;

means for clearing the lane of all pins for placement of the first pin within the location, the clearing means operable within the moving means single cycle for clearing the lane of all pins after detection of the second standing pin; and means cooperating with the moving and clearing means for synchronizing a simultaneous movement of the first pin from its stored position to within the standing position at the location, the clearing means removing the second pin from the lane during the moving of the first pin and prior to placing of the first pin at the standing position, thus replacing the second standing pin with the first pin after removing the second standing pin from the lane, the removing of the second pin from the lane and the placing of the first pin within the location being completed within the moving means single cycle.

2. The apparatus as recited in claim 1, further comprising means for delivering any pin cleared from the lane to the stored position.

3. The apparatus as recited in claim 2, wherein a plurality of pins are stored in a pattern for pin placement on the lane in the pattern, and wherein the delivering means comprises:

means for elevating pins cleared from the lane for delivering to a pin distributing means; and means for distributing pins from an elevated position above the lane to the plurality of stored positions.

4. The apparatus as recited in claim 1, further comprising a ball sensing means responsive to a ball rolling proximate the pin standing position, the ball sensing means communicating with the pin moving means for initiating the pin moving.

5. A bowling pin setting apparatus comprising:

a spotting deck movable toward and away from a bowling lane pin deck at an end of a lane for setting pins thereon, the spotting deck having a plurality of pin spotting cups for storing pins therein, one cup for each of a plurality of pin positions, each cup mounted for placing a pin in a standing position onto the pin deck when the spotting deck is proximate the pin deck, and a pin loading position when the spotting deck is displaced above the pin deck, the spotting deck operable within a single continuous movement cycle, the cycle including a first portion operable from the pin loading position to the pin standing position, and a second portion operable from the pin standing position returning to the pin loading position, each cup further having sensing means for detecting a standing pin during movement of the spotting deck toward the pin deck during the spotting deck cycle first portion;

a rake for removing pins from the pin deck, the rake movable between a position forward of the pin deck, wherein pins positioned on the pin deck are between the forward position and a pit area, and an aft position wherein the pins are pushed into the pit area, the rake operable within the spotting deck single cycle; and means for simultaneously moving the spotting deck and rake for synchronously lowering the cups for the detecting of standing pins, moving the rake to the aft position for depositing all pins on the pin deck into the pit area, returning the rake to its forward position, depositing pins stored in the cups onto the pin deck for those cups detecting the standing pins, and returning the spotting deck to its displaced position above the pin deck, the moving means Operable within the spotting deck single cycle, the moving means further responsive to a bowling ball rolled at the pins.

6. The apparatus as recited in claim 5, wherein the spotting deck moving means comprises:

a spotting deck shaft having a continuous groove along a surface of the shaft, the groove having a varying pitch for controlling linear movement of the spotting deck parallel to an axis of the shaft;

spotting deck sliding means engaging the spotting deck shaft groove, for moving the spotting deck toward and away from the pin deck at various speeds during rotation of the spotting deck shaft;

a rake shaft having a continuous groove along a surface of the rake shaft, the groove having a varying pitch for controlling linear movement of the rake parallel to an axis of the shaft; and rake sliding means engaging the rake shaft groove, wherein rotation of the rake shaft moves the rake between the forward position and the aft position at various speeds, the spotting deck shaft and rake shaft grooves formed for providing a synchronized movement of the spotting deck and rake during the spotting deck cycle.

7. The apparatus as recited in claim 6, wherein the sliding means comprise:

a slide member having a groove engaging element slidable within the shaft groove, the slide member further having a body portion for rotational movement within a sleeve; and a sleeve attached to the frame, the sleeve having a bore within a side wall for receiving the shaft, the sleeve side wall having a bore for receiving the slide member body portion, wherein rotation of the shaft causes the sleeve to move along a path parallel to the shaft axis thus providing linear movement of the sleeve along a path parallel to the shaft axis.

8. The apparatus as recited in claim 6, wherein the spotting deck shaft is positioned for rotation of the sliding means about the shaft axis, the spotting deck shaft attached to the spotting deck for vertical movement of the spotting deck with rotation of the sliding means about the spotting deck shaft.

9. The apparatus as recited in claim 6, wherein the rake shaft is rotated about its axis for linear movement of the rake sliding means and thus the rake generally horizontally along a surface of the pit area.

10. An automatic bowling pin setting apparatus for setting pins in a given pattern upon a pin deck at an end of a bowling lane, the apparatus comprising:

a frame mounted above a pin deck, the frame having a spotting deck adapted to be moved up and down above the pin deck, the spotting deck having opposing sides for mounting shafts to opposing frame sides;

a pair of spotting deck shafts, each vertically mounted to the spotting deck opposing sides, each shaft having a continuous groove within a shaft outside wall, the groove having a varying pitch for controlling vertical movement of the spotting deck;

spotting deck sliding means rotatably attached to the frame, wherein rotation of the spotting deck sliding means about each vertical shaft moves the spotting deck toward and away from the frame and thus the pin deck at various speeds throughout the movement;

a plurality of pin cups mounted to the spotting deck according to a given pattern, each cup dimensioned for storing each pin of the pattern for movement toward the pin deck and for setting of the pin therein in a standing position on the pin deck;

means cooperating with each cup for detecting a standing pin at a location within the pattern;

a pair of rake shafts, each shaft rotatably attached along frame opposing sides, each shaft having a continuous groove within a shaft outside wall, the groove having a varying pitch for controlling linear movement of rake sliding means parallel to an axis of the shaft; and rake sliding means communicating with the rake shafts, wherein rotation of the rake shaft sliding means moves the rake sliding means between the forward position and the aft position at various speeds throughout the movement, the grooves of the spotting deck shafts and rake shafts pitched for synchronization of a rake movement with a spotting deck movement for detecting a standing pin on the pin deck, clearing the pin deck of all pins, and replacing the standing pin with a pin stored within the cup, the synchronization being completed within a single cycle of movement of the sliding means across an axial length of corresponding shafts.

11. The apparatus as recited in claim 10, further comprising means for detecting a pin within a pin cup, the pin cup detecting means halting the spotting deck and raking movements until a pin is detected within each cup.

12. The apparatus as recited in claim 10, further comprising a plurality of cradles, each cradle pivotally attached to the frame for movement from a horizontal position carrying a pin to a generally vertical position for depositing the pin into an unoccupied pin cup.

13. The apparatus as recited in claim 12, further comprising pin distribution means for distributing pins delivered to the distributing means into vacant cradles, the distribution means comprising pin sensing means for pins positioned within a cradle for delivering a single pin to each cradle.

14. The apparatus as recited in claim 10, wherein each pin cup comprises:

a pair of opposing side walls;

opposing cup cradle members pivotal between the side walls for receiving a pin lower portion between the cradle members;

a level arm attached for pivoting with a cradle member, the lever arm in a first position with a pin held within the cup and a second position with an empty pin cup; and solenoid means pivotally attached to the lever arm for providing a signal indicative of pin cup occupancy.

15. A method for setting bowling pins comprising the steps of:

operating a pin spotting deck for continuous movement toward and away from a bowling lane pin deck for placing bowling pins stored at the spotting deck onto the pin deck, the pin spotting deck movement continuous within a single movement cycle toward and away from the pin deck;

detecting a first ball rolled at the pins;

sensing each pin standing after the first ball has been rolled, the sensing step made within the pin spotting deck movement toward the pin deck;

sweeping all the pins from the pin deck prior to placing stored pins on the pin deck; and replacing the sensed standing pins with stored pins, the replacing made within the pin spotting deck single movement cycle.

16. The method as recited in claim 15, further comprising the steps of:

detecting a second ball rolled at the pins standing after the replacing step;

sweeping all the pins from the pin deck; and setting pins on the pin deck for repeating the detecting, sensing, sweeping and replacing steps.

17. The method as recited in claim 15, further comprising the step of storing the pins for moving each pin toward and away from the deck for the replacing step, each pin stored within a spotting cup, each cup mounted for setting the pin within the cup onto the pin deck in the standing position.

18. The method as recited in claim 17, further comprising the steps of detecting occupancy of the spotting cup by the stored pin and halting the pin spotting deck operating step until the cup contains stored pin.

19. The method as recited in claim 17, further comprising the step of delivering the pin to a holding position for placing the pin into an empty spotting cup for the storing step.

20. The method as recited in claim 17, further comprising the steps of:

conveying the swept pins for elevating the pins above the pin deck;

elevating the conveyed pins above the pin deck for storing the elevated pin; and storing the pins within the pin cups.

21. A method for setting bowling pins comprising the steps of:

operating a pin spotting deck for positioning a plurality of standing pins on a pin deck in a patterned standing array for receiving a bowling ball rolled for knocking down the standing pins, each pin standing within a designated location of the array;

detecting a first ball rolled at the standing pins;

continuously moving the pin spotting deck through a single cycle from a position above the standing pins to a position proximate the pin deck;

detecting the standing pins remaining at each location after the first ball is rolled, the detecting step occurring within the pin spotting deck single cycle;

sweeping all pins from the pin deck, the sweeping step completed within the spotting deck single cycle moving step; and replacing the detected standing pins remaining after the first ball with replacement pins stored at the pin spotting deck, each standing pin placed within a location corresponding to each detected standing pin.

22. The method as recited in claim 21, wherein the step of sweeping all the pins comprises sweeping the standing pins remaining and fallen pins lying as deadwood on the pin deck and within a gutter adjacent the pin deck.

23. The method as recited in claim 21, further comprising the steps of:

detecting a second ball rolled at the pins remaining after the replacing step;

sweeping all the pins from the pin deck; and repeating the pin spotting deck operating step for positioning another plurality of pins on the pin deck for repeating the detecting means, sweeping and replacing steps.

24. The method as recited in claim 21, further comprising the step of storing the plurality of pins for moving the pins toward and away from the deck for the replacing step, the pins stored within a spotting cup for each of the plurality of pin designated locations, each cup mounted for positioning a pin onto the pin deck during the pin replacing step.

25. The method as recited in claim 24, further comprising the step of distributing a plurality of pins to the spotting cups, one pin delivered to one holding position proximate one cup for delivery into the cup when the cup is without a pin therein.

26. The method as recited in claim 24, wherein the holding position comprises holding the pins horizontally above the spotting cup for rotational movement into an empty cup.

27. The method as recited in claim 21, wherein the storing step comprises storing the pins in a vertical position above the pin deck within the cups.

28. The method as recited in claim 21, further comprising the steps of:

conveying the pins swept into the pit area to a position for elevating the pins above the pin deck;

elevating the conveyed pins above the pin deck for storing the elevated pins; and storing the pins for positioning the plurality of pins in the patterned array.

29. A pin setting apparatus comprising:

means for detecting one or more standing pins following passing of a first ball through the standing pins on a bowling lane pin deck;

means operable with a setting means single cycle for clearing all pins from the pin deck, including any standing pins remaining after the first ball passing; and means operable with the clearing means and prior to passing of a second ball for setting up new pins on the pin deck only at the location of the one or more standing pins, the pinsetting means operable within a single cycle for moving from a first position above the standing pins to a second position for the setting up of new pins and returning to the first position after the setting of new pins, the setting of new pins by the setting means synchronized with the clearing of all pins by the clearing means, each completed within the single movement cycle.

30. The apparatus as recited in claim 29, wherein the setting means comprises:

a spotting deck;

a spotting deck shaft having a continuous groove along a surface of the shaft, the groove having a varying pitch for controlling linear movement of the spotting deck parallel to an axis of the shaft; and spotting deck sliding means engaging the spotting deck shaft groove for moving the spotting deck toward and away from the pin deck at various speeds during rotation of the spotting deck shaft.

31. The apparatus as recited in claim 30, wherein the clearing means comprises:

a rake;

a rake shaft having a continuous groove along a surface of the rake shaft, the groove having a varying pitch for controlling linear movement of the rake parallel to an axis of the shaft; and rake sliding means engaging the rake shaft groove wherein rotation of the rake shaft moves the rake between the forward position and the aft position at various speeds, the spotting deck shaft and rake shaft grooves formed for providing a synchronized movement of the spotting deck and rake during the spotting deck cycle.

* * * * *